United States Patent [19]

Küpper

[11] Patent Number: 4,953,799

[45] Date of Patent: Sep. 4, 1990

[54] CUTTING APPARATUS FOR SEVERING TRAILING YARNS ON SPINNING BOBBINS

[75] Inventor: Wilhelm Küpper, Wegberg, Fed. Rep. of Germany

[73] Assignee: W. Schlafhorst & Co., Moenchengladbach, Fed. Rep. of Germany

[21] Appl. No.: 403,701

[22] Filed: Sep. 6, 1989

[30] Foreign Application Priority Data

Sep. 7, 1988 [DE] Fed. Rep. of Germany ... 8811305[U]

[51] Int. Cl.[5] ..... B65H 54/22

[52] U.S. Cl. ..... 242/35.6 E

[58] Field of Search ..... 242/35.6 E, 35.6 R, 242/35.5 A, 18 R

[56] References Cited

U.S. PATENT DOCUMENTS

| | | | |
|---|---|---|---|
| 3,464,640 | 9/1969 | Kupper | 242/35.6 E |
| 3,923,264 | 12/1975 | Kupper | 242/35.6 E |
| 4,009,840 | 3/1977 | Muller | 242/35.6 E |
| 4,103,836 | 8/1978 | Kupper | 242/35.6 E |
| 4,824,037 | 4/1989 | Haberkorn | 242/35.6 E |
| 4,842,206 | 6/1989 | Kawasaki et al. | 242/35.6 E X |
| 4,848,077 | 7/1989 | Kawarabashi et al. | 242/35.6 E X |

*Primary Examiner*—Stanley N. Gilreath

*Attorney, Agent, or Firm*—Herbert L. Lerner; Laurence A. Greenberg

[57] ABSTRACT

A cutting assembly for severing trailing yarns on spinning bobbins being transported along a transport route includes a cutting apparatus disposed at a given level on one side of a transport apparatus for transporting spinning bobbins upright on mandrels along a transport route. A feeder is disposed at the given level on the opposite side of the transport apparatus for feeding the trailing yarns to the cutting apparatus.

8 Claims, 2 Drawing Sheets

CUTTING APPARATUS FOR SEVERING TRAILING YARNS ON SPINNING BOBBINS

SPECIFICATION

The invention relates to a cutting apparatus for severing trailing yarns on spinning bobbins that are transported along a transport route.

When spinning bobbins are doffed from spindles onto a conveyer belt, the yarn traveling from the spinning station is cut or lopped. Since the yarn cannot be cut directly against the body of the bobbins, there is always some leftover yarn hanging down from the spinning bobbin. Especially when the yarn catches on obstacles, the transporting motion can cause windings of the wound-up yarns to come loose from the bobbin package, forming so-called trailing yarns, which represent a considerable source of problems in later handling and transporting of the bobbins.

Yarn severing apparatus are already known that are intended to cut off the yarn as close as possible after the spinning bobbin during the doffing between the full spinning bobbin and the spinning station. For instance, Published Japanese Application No. 61-47834 discloses a horizontally disposed, mechanically actuated cutting apparatus with a plurality of scissors-like cutting blades that sever the yarn when the full bobbin is raised from the spindle. As the bobbin is raised from the spindle and moved away from the spindle, the yarn catches in a V-shaped groove, is pulled into a groove adjoining it, and is severed by the scissors-like cutting blades.

However, such an apparatus can only be used if the bobbins are underwound to a defined extent and if there is sufficient space in front of the creel for the cutting apparatus, one of which must be provided for each spindle.

That kind of apparatus is complicated and can be used only if bobbins with an underwinding are being produced.

It is accordingly an object of the invention to provide a cutting apparatus for severing trailing yarns on spinning bobbins, which overcomes the hereinafore-mentioned disadvantages of the heretofore-known devices of this general type, which is simple in construction and which can be used for variously wound spinning bobbins.

With the foregoing and other objects in view there is provided, in accordance with the invention, a cutting assembly for severing trailing yarns on spinning bobbins being transported along a transport route, comprising a cutting apparatus disposed at a given level on one side of a transport apparatus transporting spinning bobbins upright on mandrels along a transport route, and a feeder disposed at the given level on the opposite side of the transport apparatus for feeding the trailing yarns to the cutting apparatus.

The apparatus according to the invention can advantageously be used for bobbins that are transported upright on mandrels. The finished bobbins come from their spinning stations and pass successively through the cutting apparatus according to the invention, so that only one cutting apparatus is required for each side of a spinning machine.

The cutting apparatus is located alongside the transport route, and advantageously all of the trailing threads, regardless of whether the bobbins are wound clockwise or counterclockwise, can advantageously be engaged by it, because a feeder for the trailing yarns is disposed at the level of the cutting apparatus and faces it.

In accordance with another feature of the invention, the feeder includes at least one air nozzle aimed at the cutting apparatus. If a bobbin moves past the cutting apparatus, each trailing yarn can be blown into the cutting apparatus by a brief pulse of air from the air nozzle.

An alternative to the air nozzle is provided by mechanically transferring yarn to the cutting apparatus. Therefore, in accordance with a further feature of the invention, the feeder includes a lever extending over the entire length of the bobbins, the lever being pivotable transversely relative to the transport apparatus, so that it is out of the way above the transport apparatus.

Such a lever is capable of engaging every trailing yarn, regardless of the point on the bobbin from which it unwinds, and it is capable of delivering it to the cutting apparatus.

In accordance with an added feature of the invention, the cutting apparatus extends over the entire length of the bobbins, and the cutting apparatus includes a plurality of scissors disposed one above the other. With the aid of this multiple scissor configuration, it is possible to cut off the trailing yarns as close as possible to the yarn package, regardless of the level at which they unwind from the yarn package. This eliminates the danger that the remaining, protruding yarn end might develop into a new trailing yarn.

In accordance with an additional feature of the invention, the scissors include an approximately sawtooth-profiled catch plate disposed parallel to the transport apparatus, the catch plate having sawteeth each having one side in the form of a cutting edge, movable cutting blades each being associated with a respective one of the sawteeth, and a common actuating device connected the cutting blades. This makes the cutting apparatus very simple in structure, because only one of the scissors blades needs to be moved at a time. It is also possible to provide a configuration of scissors having two movable cutting blades behind the catch plate, with one scissor configuration in every space between two sawteeth.

In accordance with yet another feature of the invention, there is provided a control device operatively connecting the cutting apparatus and the yarn feeder to the transport apparatus, so that they are both actuated only when the bobbins have assumed the most favorable position with respect to the cutting apparatus for cutting off the trailing yarn.

In accordance with yet a further feature of the invention, there is provided a suction device disposed on the cutting apparatus for removing cut-off trailing yarns by suction. This is done in order to prevent the cut-off trailing yarns from catching in the transport apparatus and on the ensuing bobbins.

In accordance with a concomitant feature of the invention, the cutting apparatus is disposed alongside the transport apparatus between a circular spinning machine and a spooling frame. This provides an optimal configuration for the cutting assembly.

Other features which are considered as characteristic for the invention are set forth in the appended claims.

Although the invention is illustrated and described herein as embodied in a cutting apparatus for severing trailing yarns on spinning bobbins, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
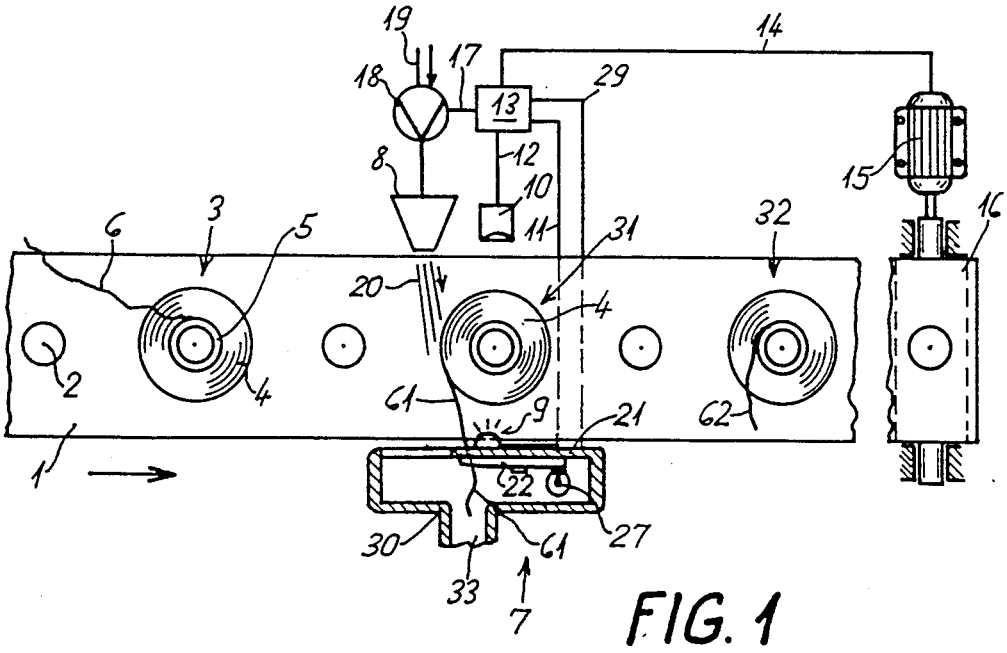
FIG. 1 is a fragmentary, diagrammatic, top-plan view of a cutting apparatus having an air nozzle as a feeder for feeding trailing yarns to the cutting apparatus.

Referring now to the figures of the drawing in detail and first, particularly, to FIG. 1 thereof, it is seen that spinning bobbins 3 are transported upright in the direction of the arrow on mandrels 2 located on a mandrel belt 1 serving as the transport apparatus, from a non-illustrated circular spinning machine to a spooling frame. Every other mandrel of the mandrels that follow is occupied by a bobbin. The mandrels located between the bobbins were equipped with empty tubes at a spinning machine prior to doffing.

The bobbins 3 are formed of a yarn package 4 that has been wound onto a tube 5. During doffing or during the ensuing transport, a trailing yarn or thread 6 is developed on the bobbin 3. The trailing yarn is already next to the mandrel belt 1 and therefore is a threat to the further transport of the bobbins.

The bobbins 3 move in increments to a cutting apparatus 7, which is disposed beside the mandrel belt. A feeder 8 for the trailing yarns is located opposite the cutting apparatus. If a bobbin is located in a predetermined position with respect to the cutting apparatus 7, a cutting operation for a trailing yarn that might perhaps be present is initiated.

In FIG. 1, the bobbin 31 is in such a position.

The positioning is effected in the present exemplary embodiment by means of a light-emitting diode (LED) 9 acting as an emitter of a beam of light and a photoelectric cell 10 acting as a receiver of the beam. If the beam path is broken, the bobbin 31 is in the correct position, and a motor 15 of a drive roller 16 of the mandrel belt 1 is stopped through a control line 14. The LED 9 is connected through a signal line 11 and the photoelectric cell 10 is connected through a signal line 12 to a control device 13, which passes control commands thereof to the drive motor 15 of the driver roller 16 of the mandrel belt 1 through the control line 14.

Figure 2:
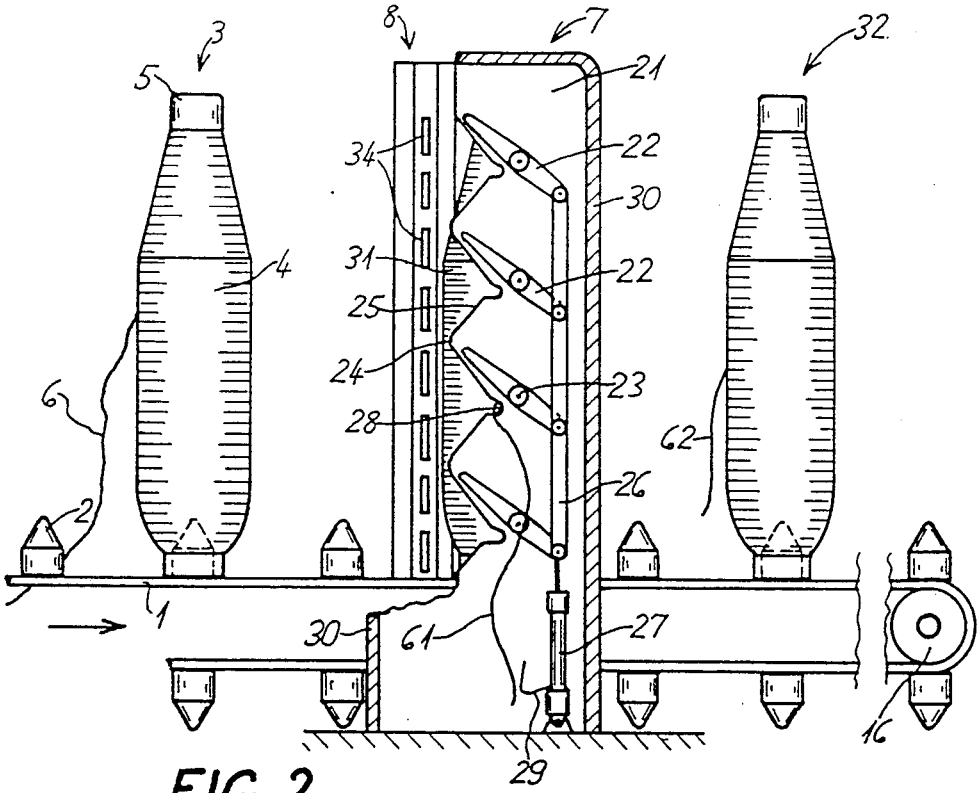
FIG. 2 is a fragmentary, front-elevational view of the apparatus of FIG. 1.

Through a control line 17, the control device 13 also controls a valve 18 in a compressed air line 19 which leads from a non-illustrated compressed air source to the feeder 8. A trailing yarn 61 of a bobbin 31 is blown into the cutting apparatus 7 with a brief stream of compressed air 20 from air nozzles of the feeder 8. As FIG. 2 shows, the cutting apparatus 7 is formed of a sawtooth-profiled or outlined catch plate 21 which is parallel to the mandrel belt 1. Movable cutting blades 22 are disposed one above the other on the side of the catch plate 21 facing away from the mandrel belt 1 and form scissors along with the catch plate. The cutting blades 22 may each be pivoted about a pivot point 23. In a rest position, the cutting blades 22 are each parallel to one edge of a sawtooth 24. The edge of a sawtooth facing a cutting blade is constructed as a cutting edge 25. The cutting blades 22 are connected to one another by a lever 26, which in turn is connected to an actuation device 27.

As seen in FIG. 1, the trailing yarn 61 on the bobbin 31 has been caught in a specially recessed groove 28. A respective one of the grooves 28 has been milled into the catch plate 21 between each two sawteeth 24. The control device 13 triggers the actuating device 27 through a control line 29, so that the cutting blades 22 are actuated. The trailing yarn 61 of the bobbin 31 is severed close to the yarn package 4.

As can be seen from FIG. 1, the catch plate 21 of the cutting apparatus 7 is surrounded by a housing 30 on the side of the catch plate on which the cutting blades 22 are disposed. A suction conduit 33, which is connected to a non-illustrated source of vacuum or suction, removes the cut-off ends of the trailing yarns by suction.

A bobbin 32 having a trailing yarn 62 which has already been shortened by the cutting apparatus 7, is seen downstream of the cutting apparatus 7 in the direction of conveyance of the mandrel belt 1. The remaining yarn end 62 is therefore so short that it can no longer catch in transport devices and cause problems.

In the front view of the cutting apparatus according to the invention shown in FIG. 2, the housing 30 has been partially broken away for the sake of clarity. The bobbin 31 is located behind the catch plate 21, where it cannot be seen. Only the trailing yarn 61 is visible, as it lies in the groove 28 of the sawtooth-profiled catch plate 21.

The feeder 8 is a polygonal column, which is located beside the mandrel belt 1 and is at least as high as the largest bobbin. A number of air nozzles 34 are disposed one above the other on the narrow side of the feeder, opposite the cutting apparatus. The compressed air stream 20 which feeds the trailing yarns to the cutting apparatus 7, emerges from the air nozzles.

The difference in trailing yarn length between a bobbin 3 having an uncut trailing yarn and a bobbin 32 having a cut trailing yarn is clearly visible.

The trailing yarn 6 of the bobbin 3 is so long that it projects past the mandrel belt 1 and could catch on parts of the machine located beside the mandrel belt. In contrast, the shortened trailing yarn 62 of the bobbin 32 does not present such a danger.

Figure 4:
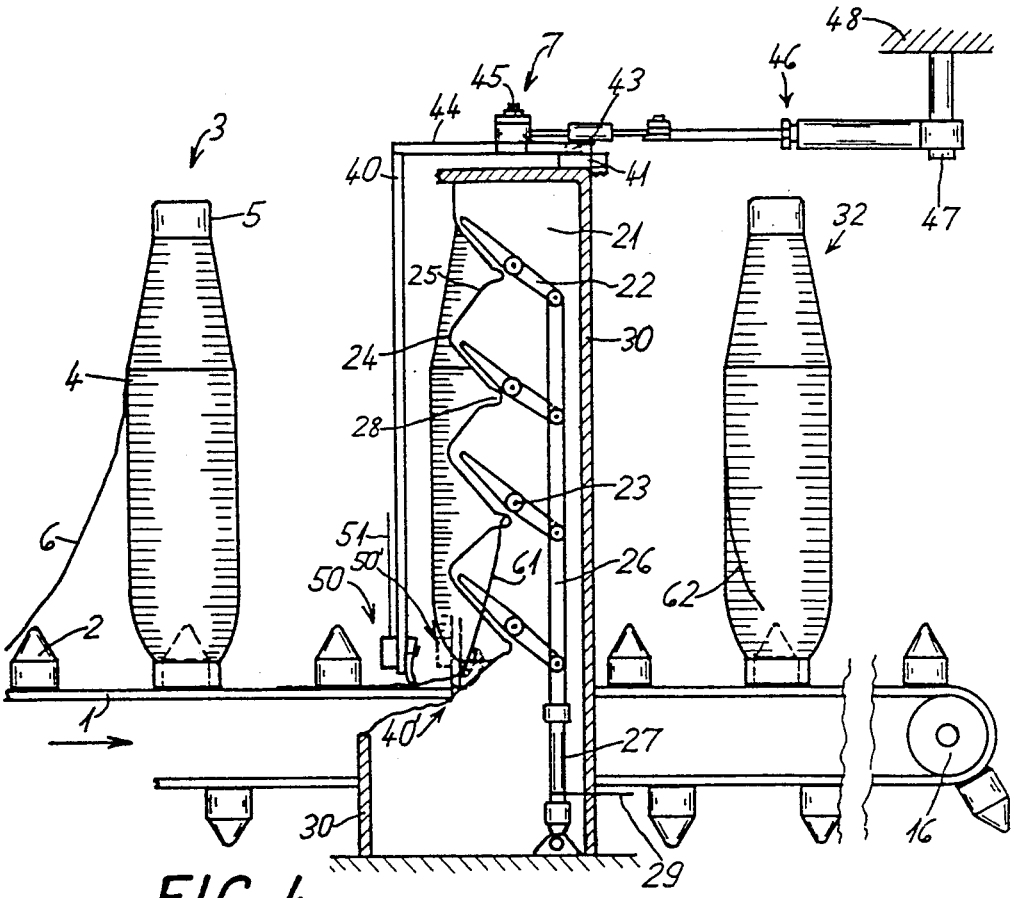
FIG. 4 is a front-elevational view of the apparatus of FIG. 3.
Figure 3:
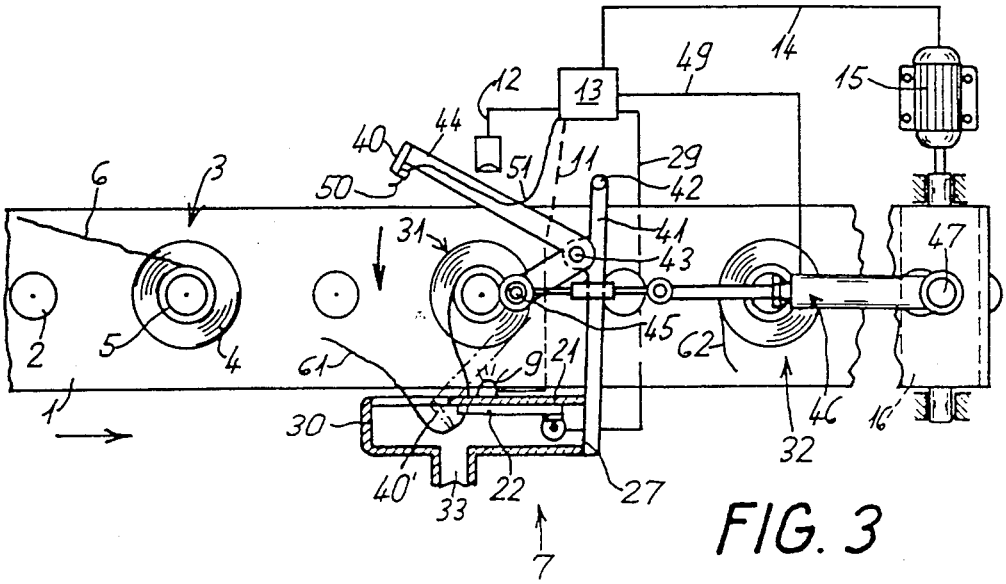
FIG. 3 is a view similar to FIG. 1 of another embodiment of the cutting apparatus according to the invention, in which the feeder for the trailing yarns is a lever.

The second exemplary embodiment, which is shown in FIGS. 3 and 4, differs that of FIGS. 1 and 2 only in terms of the feeder. Instead of having a pneumatic feeder as in the first exemplary embodiment, the second exemplary embodiment has a mechanical yarn feeder. The structure of the cutting apparatus is identical to that of the cutting apparatus of the first exemplary embodiment. The same reference numerals are therefore used for identical structural characteristics. The process of shortening of the trailing yarns is precisely as described for the first exemplary embodiment.

A mechanical feeder 40 which is seen in the figures is a lever that extends over the entire length of the bobbin and is capable of being pivoted transversely relative to the transport route of the bobbins. The actuating mechanism of the feeder is disposed above the mandrel belt, beyond the reach of the bobbins. The mandrel belt 1 is spanned by a bridge 41, which is supported at one side on the housing 30 of the cutting apparatus 7 and at the other side on a support 42 alongside the mandrel belt. A pivot lever 44 that carries the feeder 40 on the end of one leg thereof, is supported in a joint 43 on the bridge 41. An actuating device 46, which is an electromagnetically actuated lifting cylinder, is connected to the other leg of the pivot lever 44 at a pivot point 45. A bolt 47 carries the actuating device 46 in such a way as to fix it against relative rotation and to secure it to a support 48 which is not shown in detail.

If the mandrel belt 1 moves in the direction of the arrow, the feeder 40 is pivoted outside the belt. If a bobbin, for instance the bobbin 31, is in a position that allows severing of the trailing yarns, or in other words if the LED 9 facing the photoelectric cell 10 is blocked by the bobbin 31, the mandrel belt 1 is stopped. To this end, the control device 13 acts over the control line 14 to stop the drive motor 15 of the drive roller 16 of the mandrel belt 1. The bobbin 31 is therefore correctly positioned for the cutting operation. The actuating device 46 is switched on by the control device 13 over the control line 49 causing an attraction of an armature of the actuating device 46, which pivots the pivot lever 44 having the feeder 40 out of its rest position past the mandrel belt into a position 40, shown in phantom. An actuatable yarn gripper 50 is located at the end or foot of the feeder 40. Trailing yarns, such as the trailing yarn 61 lying on the mandrel belt 1, can be grasped with the yarn gripper 50. If the feeder 40 is pivoted into the position 40' indicated in phantom, or in other words if the yarn gripper 50 is in a position 50, behind the catch plate 21 as shown in FIG. 4, then the trailing yarn, in this case the yarn 61, is securely fed into a groove 28 of the catch plate 21. The yarn gripper 50 is closed by the control device 13 over a control line 51. The control device 13 then actuates the actuating device 27 of the cutting blades 22 over a control line 29, and the trailing yarn 61 is cut off. The yarn gripper 50 is re-opened by the control device 13 over the control line 51, and at the same time suction is briefly applied to the suction or draw-off conduit 33, in order to aspirate the cut-off end of the trailing yarn. Then the control device 13 switches the suction off again, it causes the feeder 40 to pivot into its initial or rest position through the use of the actuating device 46, it switches on the drive motor 15 of the mandrel belt, and it advances the belt by twice the spacing between two mandrels, until a new bobbin is again positioned before the cutting apparatus. The cutting operation then repeats from the beginning.

The bobbin 32 has an already-cut trailing yarn 62, which is so short that it can no longer catch in the transport apparatus, where it could unwind the cop.

I claim:

1. Cutting assembly, comprising a transport apparatus transporting spinning bobbins upright on mandrels along a transport route, a cutting apparatus disposed at a given level on one side of said transport apparatus for severing trailing yarns on the bobbins, and a feeder disposed at said given level on the opposite side of said transport apparatus for feeding the trailing yarns to said cutting apparatus.

2. Cutting assembly according to claim 1, wherein said feeder includes at least one air nozzle aimed at said cutting apparatus.

3. Cutting assembly according to claim 1, wherein said feeder includes a lever extending over the entire length of the bobbins, said lever being pivotable transversely relative to the transport apparatus.

4. Cutting assembly according to claim 1, wherein said cutting apparatus extends over the entire length of the bobbins, and said cutting apparatus includes a plurality of scissors disposed one above the other.

5. Cutting assembly according to claim 4, wherein said scissors include an approximately sawtooth-profiled catch plate disposed parallel to the transport apparatus, said catch plate having sawteeth each having one side in the form of a cutting edge, movable cutting blades each being associated with a respective one of said sawteeth, and a common actuating device connected said cutting blades.

6. Cutting assembly according to claim 1, including a control device operatively connecting said cutting apparatus and said yarn feeder to the transport apparatus.

7. Cutting assembly according to claim 1, including a suction device disposed on said cutting apparatus for removing cut-off trailing yarns.

8. Cutting assembly according to claim 1, wherein said cutting apparatus is disposed alongside the transport apparatus between a circular spinning machine and a spooling frame.

* * * * *